US005287164A

United States Patent [19]

Watanabe

[11] Patent Number: 5,287,164

[45] Date of Patent: Feb. 15, 1994

[54] PAPER TRAY CAPABLE OF SIMULTANEOUSLY HOLDING SHEETS OF DIFFERENT SIZES

[75] Inventor: Junji Watanabe, Yokohama, Japan

[73] Assignee: Kabushiki Kaisha Toshiba, Kawasaki, Japan

[21] Appl. No.: 787,677

[22] Filed: Nov. 4, 1991

[30] Foreign Application Priority Data

Nov. 30, 1990 [JP] Japan ..... 2-340222

[51] Int. Cl.[5] ..... G03G 21/00

[52] U.S. Cl. ..... 355/311; 271/9; 271/145; 355/322

[58] Field of Search ..... 355/308, 309, 311, 322; 271/9, 117, 171, 145; 211/72, 59.4, 50

[56] References Cited

U.S. PATENT DOCUMENTS

| | | | |
|---|---|---|---|
| 4,106,763 | 8/1978 | Tani et al. | 271/9 |
| 4,569,582 | 2/1986 | Hyltoft | 355/309 X |
| 5,044,620 | 9/1991 | Ruch et al. | 271/9 |
| 5,105,231 | 4/1992 | Watanabe et al. | 355/323 |

*Primary Examiner*—A. T. Grimley
*Assistant Examiner*—Nestor R. Ramirez
*Attorney, Agent, or Firm*—Limbach & Limbach

[57] ABSTRACT

In a paper feed unit, a plurality of stacking plates are stacked in a box. The stacking plates can stack paper of different sizes and are stacked on each other. Paper stored on each stacking plate is taken out by a pickup roller, a paper feed roller, and a separation roller. These rollers can be moved to positions for taking out paper stored on the stacking plates. Taken-out paper is guided to a photosensitive drum through guide plates.

15 Claims, 8 Drawing Sheets

PAPER TRAY CAPABLE OF SIMULTANEOUSLY HOLDING SHEETS OF DIFFERENT SIZES

BACKGROUND OF THE INVENTION

1. Field of the Invention

The present invention relates to a paper feed unit and an image forming apparatus, e.g., an electronic copying machine or a laser printer, to which the paper feed unit is mounted.

2. Description of the Related Art

An electronic copying machine has a paper feed unit mounted on it. A conventional paper feed unit stores copying paper (to be referred to as paper hereinafter) of only one size. U.S. Pat. No. 4,953,844 discloses an electronic copying machine capable of copying on paper of a plurality of sizes, a plurality of paper feed cassettes corresponding in number to the paper sizes are mounted all at once, or are exchangeably mounted one at a time. Since a plurality of paper feed units are used, the cost is increased. The paper feed cassettes must be exchanged in accordance with the sizes of the paper to be used, requiring a cumbersome paper feed operation. An extra space is required to store paper feed cassettes which are not currently used. Furthermore, although paper sheets of different sizes are used at different frequencies, the conventional paper feed cassettes have the same size to store the same number of paper sheets in order to facilitate mounting of the cassettes to the electronic copying machine. Therefore, paper of a frequently used size must be replenished often.

SUMMARY OF THE INVENTION

It is an object of the present invention to provide an apparatus for feeding image bearing members which can store image bearing member of a plurality of sizes.

It is another object of the present invention to provide an apparatus for feeding image bearing members which can set the number of image bearing members to be stored in accordance with the frequency of use of image bearing member.

It is still another object of the present invention to provide an image forming apparatus which can selectively pick up and feed image bearing member of plurality of sizes from a single feeding apparatus.

It is still another object of the present invention to provide an image forming apparatus which does not require exchange of the apparatus for feeding image bearing member.

In order to achieve the above objects, an apparatus for feeding image bearing members comprises a plurality of container means for storing image bearing members respectively, the container means being stocked on one another, means, detachably mounted in the feeding apparatus, for supporting each of the container means as a unit so as to allow access to the image bearing members contained in each container means, and means for individually taking out image bearing members contained in each container means when said supporting means is mounted in the feeding apparatus.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

A preferred embodiment of the present invention will be described in detail with reference to the accompanying drawings.

Figure 1:
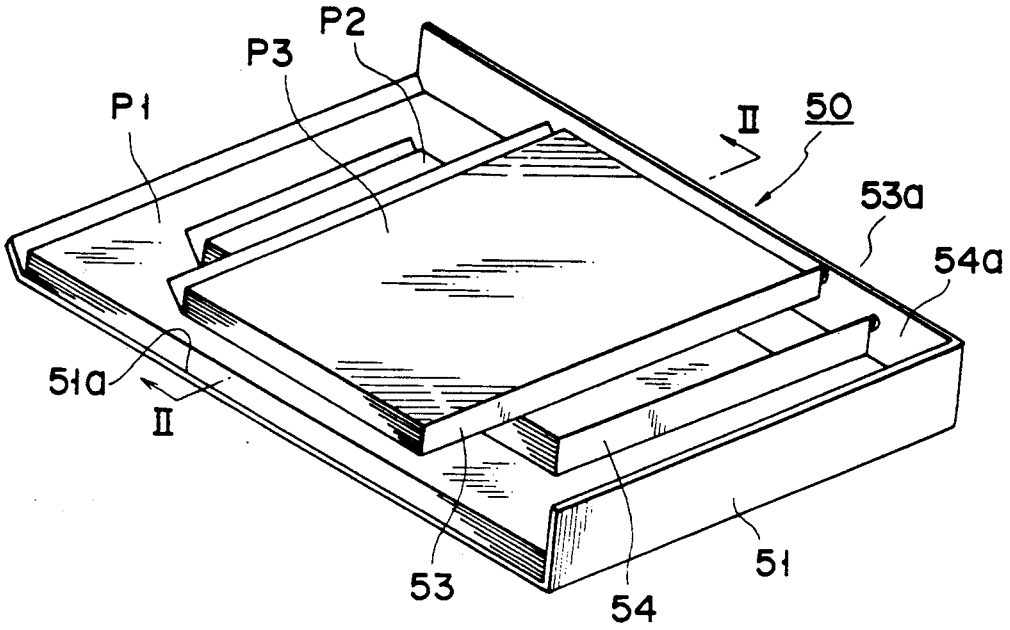
FIG. 1 is a perspective view of an embodiment of a paper feed cassette according to the present invention in which a cover is removed and one side frame is omitted.
Figure 2:
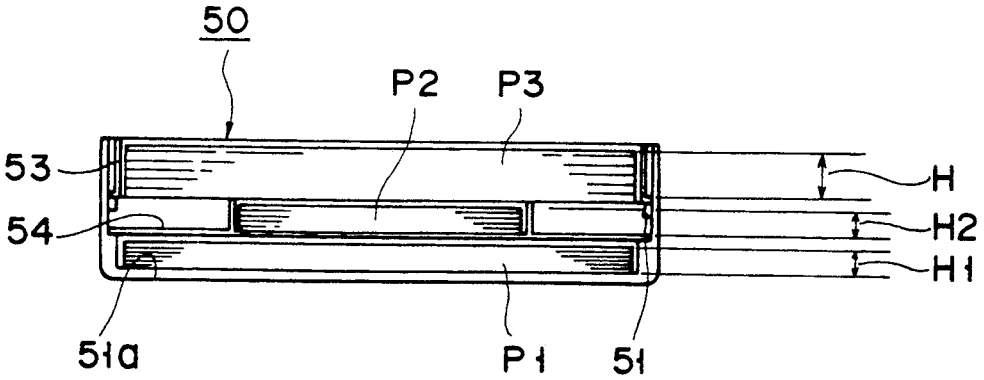
FIG. 2 is a sectional view taken along a line II—II of FIG. 1.
Figure 3:
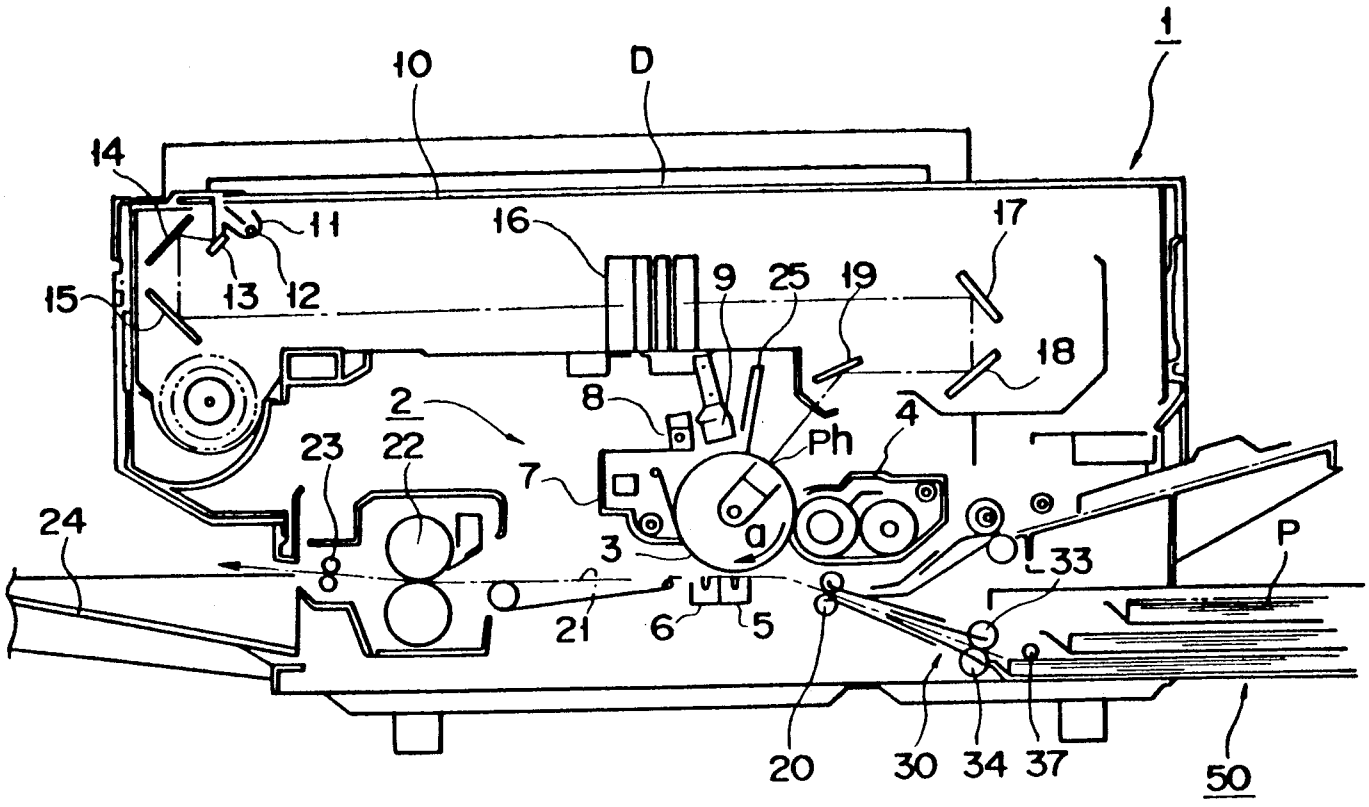
FIG. 3 is a schematic illustration showing the overall arrangement of an image forming apparatus mounting the paper feed cassette according to the present invention.

FIG. 3 schematically shows the overall arrangement of an electronic copying machine as an image forming apparatus according to the present invention. This electronic copying machine has an image formation means 2 in its main body 1. The image formation means 2 has a photosensitive drum 3 rotatably supported at substantially the central portion of the interior of the main body 1. A developing unit 4, a transfer unit 5, a separation unit 6, a cleaning unit 7, a discharger 8, and a charger 9 are sequentially arranged around the photosensitive drum 3. The photosensitive drum 3 is rotated in a direction of an arrow a and uniformly electrified by the charger 9.

A document table 10 comprising a transparent glass plate is provided on the upper surface of the main body 1. A document D is stacked on the document table 10. An image of the document D is formed on the photosensitive drum 3 through an optical system including an exposure lamp 12, the rear portion of which is surrounded by a reflector 11, first, second, and third reflecting mirrors 13, 14, and 15, a lens 16, and fourth, fifth, and sixth reflecting mirrors 17, 18, and 19. An electrostatic latent image is formed on the photosensitive drum 3 in this manner.

The electrostatic latent image formed on the photosensitive drum 3 is developed by the developing unit 4. The developed image is transferred onto an image bearing member, such as a paper, OHP sheet, etc. by the transfer unit 5. Thereinafter the image bearing member is referred as the paper P in this specification. The paper P is plain paper and is picked up from a paper feed cassette 50 by a paper takeout mechanism 30 and is fed.

The paper P subjected to image transfer by the transfer unit 5 is separated from the photosensitive drum 3 by the separation unit 6 utilizing AC corona discharge and conveyed to a fixing unit 22 through a convey belt 21.

The paper P, on which the developed image is fused and fixed by the fixing unit 22, is discharged onto a paper discharge tray 24 by a paper discharge roller pair 23.

After a series of processing operations described above, some developing agent remains on the photosensitive drum. The residual developing agent is cleaned by the cleaning unit 7. The potential on the photosensitive drum 3 is set to be a predetermined level or less by the discharger 8, and a subsequent copying operation can be performed.

An erasure array 25 is provided above and close to the photosensitive drum 3 between the charger 9 and an exposure unit Ph along the axis of rotation of the photosensitive drum 3. When a designated area of a document image is to be copied, the erasure array 25 can partially erase a document image on the photosensitive drum 3.

Figure 4:
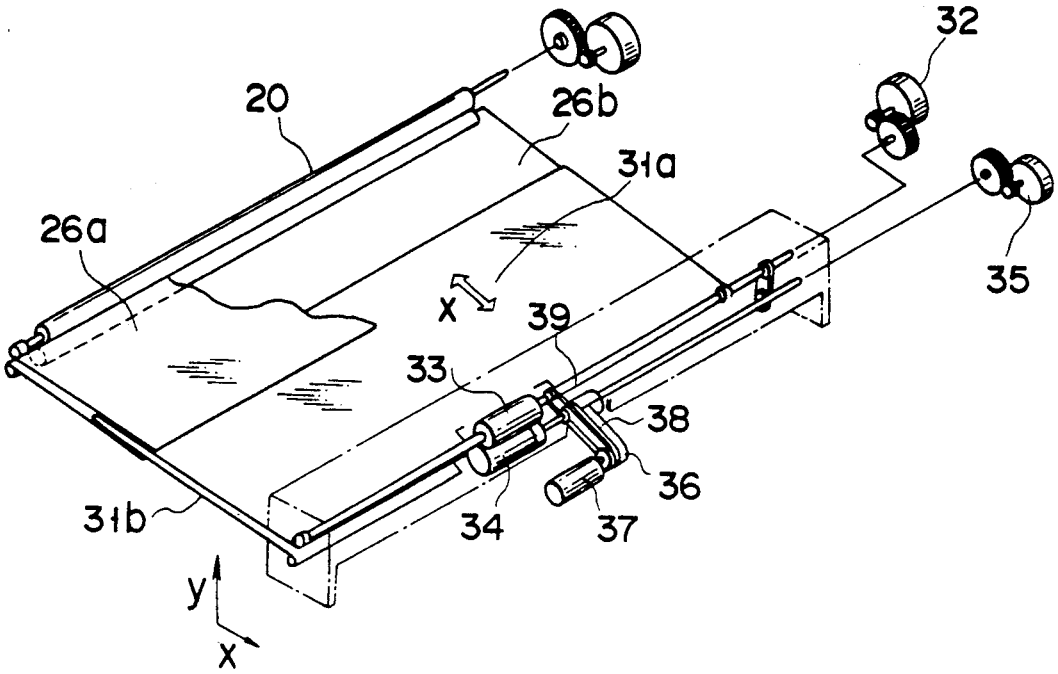
FIGS. 4 and 5 are schematic illustrations showing a paper takeout structure of the image forming apparatus shown in FIG. 3.

As shown in FIG. 4, the paper takeout mechanism 30 has a pair of upper and lower guide plates 26*a* and 26*b* on the registration roller 20 side, and a pair of upper and lower guide plates 31*a* and 31*b* on the side of an upper paper feed roller 33 and a lower separation roller 34. The guide plates 26*a* and 26*b* have a predetermined gap therebetween, and the guide plates 31*a* and 31*b* similarly have a predetermined gap therebetween. The distal end portions of the guide plates 31*a* and 31*b* are inserted between the guide plates 26*a* and 26*b* to be freely movable forward and backward (in a direction of arrow x). The upper paper feed roller 33 and the lower separation roller 34 are arranged at the upstream side proximal end portions of the guide plates 31*a* and 31*b* and are rotated by a first drive motor 32. A pickup roller 37 is mounted on an arm 36 which is moved vertically (in a direction of arrow y) by a second drive motor 35. The pickup roller 37 is rotated by belts 38 and 39 in synchronism with the upper paper feed roller 33. When the arm 36 is moved downward, the pickup roller 37 selectively picks up the paper P stored in the paper feed cassette 50 (to be described later) and supplies it between the upper and lower rollers 33 and 34.

Figure 5:
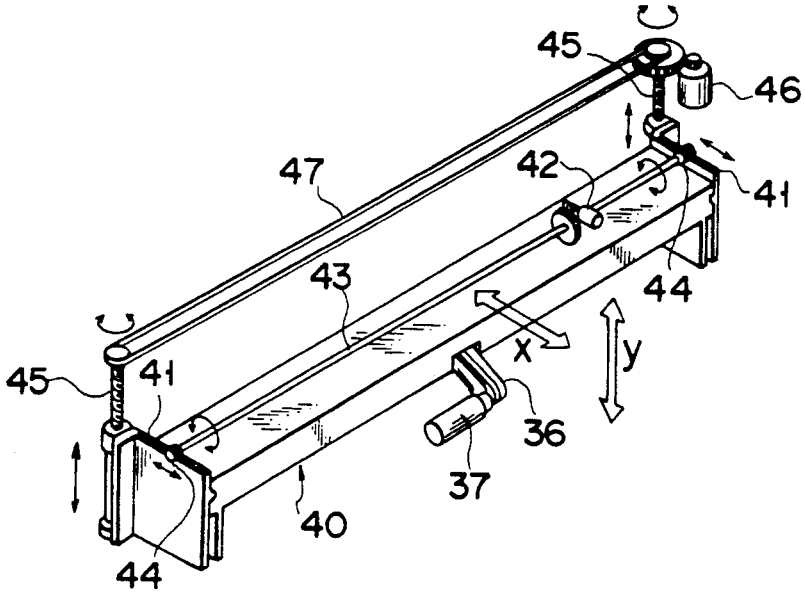
Figure 6:
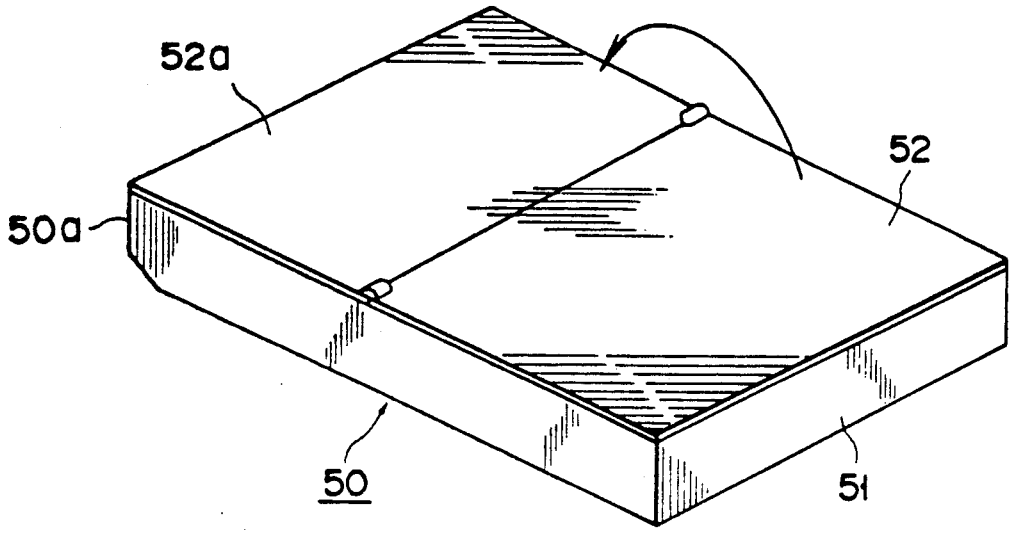
FIG. 6 is a perspective view of the paper feed cassette to which the cover is mounted.
Figure 7:
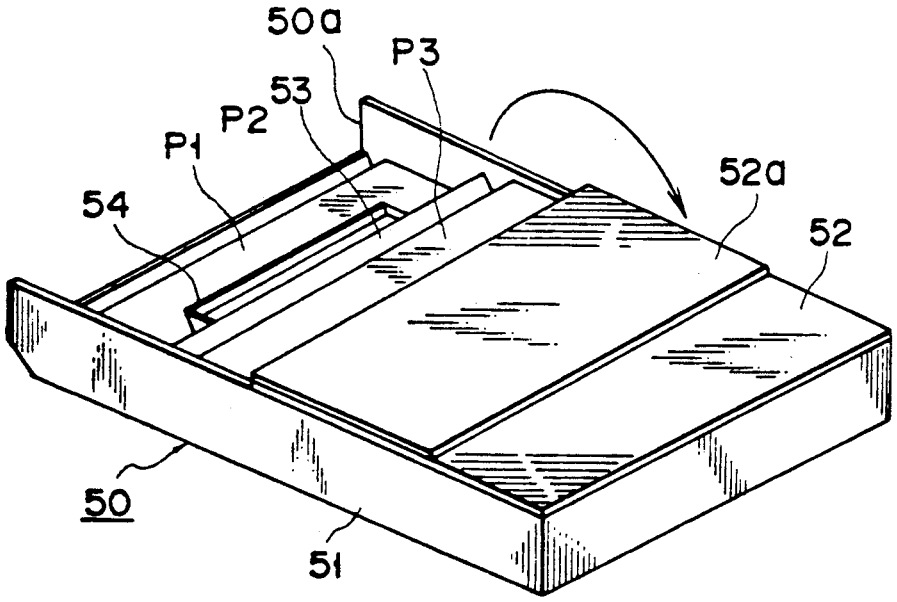
FIG. 7 is a perspective view of the paper feed cassette the cover of which is opened.

The guide plates 31*a* and 31*b*, the upper and lower rollers 33 and 34, and the pickup roller 37 are assembled on and supported by a support frame 40. Racks 41 are provided on two ends of the support frame 40 and pinions 44 respectively mesh with the racks 41, as shown in FIG. 5. The pinions 44 are mounted on two ends of a rotating shaft 43 rotated by a third drive motor 42. When the rotating shaft 43 is rotated, the support frame 40 is moved forward and backward in the direction x by the pinions 44. Lead screws 45 are screwed in the two end portions of the support frame 40. The lead screws 45 are rotated by a toothed belt 47 driven by a fourth drive motor 46. When the lead screws 45 are rotated, the support frame 40 is moved vertically in the direction y. The reciprocal movement in the direction x and the vertical movement in the direction y of the support frame 40 move the guide plates 31*a* and 31*b*, the upper add lower rollers 33 and 34, and the pickup roller 37 forward and backward in the direction x and vertically in the direction y, respectively.

The paper feed cassette 50 mounted on the main body 1 has a cassette case 51 and a cover 52, as shown in FIGS. 1, 2, 6, and 7. The cover 52 covers an opening on the upper surface of the cassette case 51 and is removable. An opening 50*a* is formed in an end face of the paper feed cassette 50 on the main body 1 side, so that paper can be taken out through the opening 50*a*. A front half 52*a* of the cover 52 is foldable to a back half of the cover 52 so that a portion of the paper P on the takeout side is exposed when the paper feed cassette 50 is mounted on the main body 1.

An inner bottom surface 51*a* of the cassette case 51 as the lowermost stage thereof has a size to store, e.g., A3-sized paper $P_1$ which is a maximum size in use.

First and second stacking plates 53 and 54 are vertically stacked in the cassette case 51 so that A3-sized paper $P_1$ are stored in the lowermost stage, different-sized (e.g., B5-sized) paper $P_2$ are stored in the middle stage, and frequently used (e.g., $A_4$-sized) paper $P_3$ are stored in the uppermost stage. A storing height H of the paper $P_3$ arranged on the uppermost first stacking plate 53 is larger than a storing height $H_1$ or $H_2$ of other stages. In fine, a large number of sheets of paper $P_3$ can be stored on the first stacking plate 53.

Figure 8:
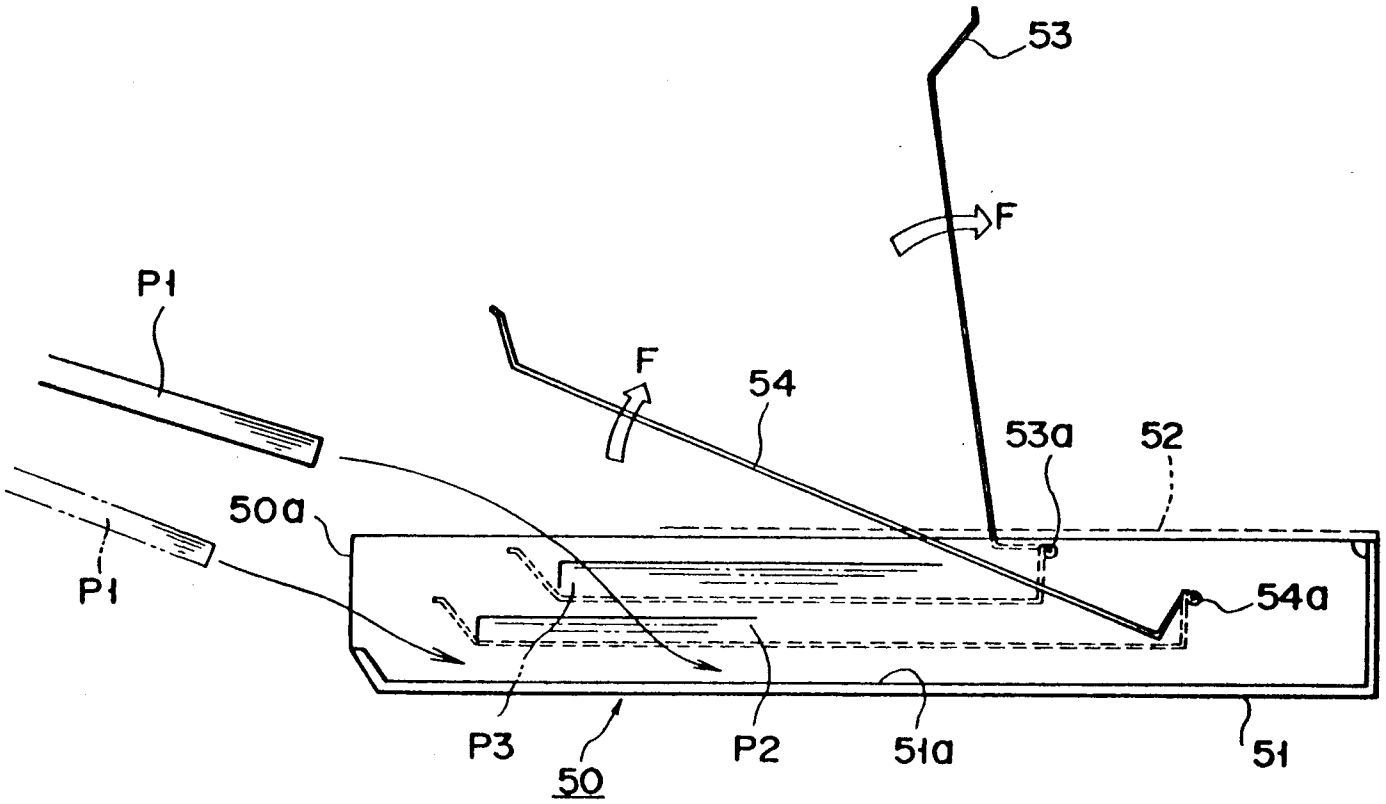
FIG. 8 is an illustration showing a pivot state of stacking plates provided in the box of the paper feed cassette.

One end of each of the first and second stacking plates 53 and 54 is pivotally supported on an axis 53*a* or 54*a*, as shown in FIG. 8. The stacking plates 53 and 54 are lifted, as indicated by an arrow F, to facilitate replenishment of the paper $P_1$, $P_2$, and $P_3$ to the inner bottom surface 51*a* and the first and second stacking plates 53 and 54, respectively.

Figure 14:
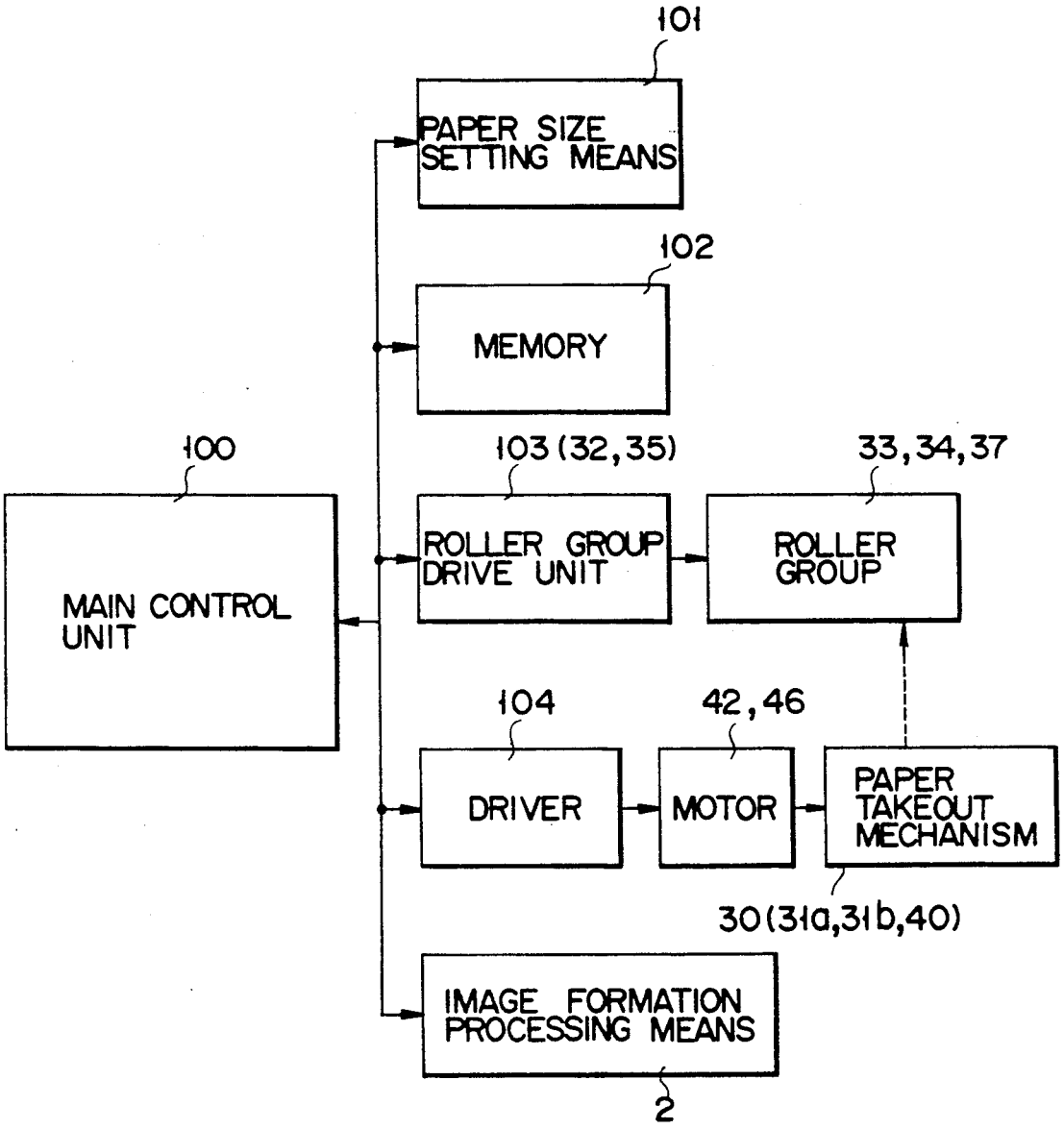
FIG. 14 is a schematic control block diagram of the image forming apparatus.

FIG. 14 schematically shows a control unit. This control unit 100 is connected to a paper size setting means 101, a memory 102, a roller group drive unit 103, a driver 104, and an image formation means 2. The paper size setting means 101 sets a desired paper size in response to setting designated by an operation panel (not shown), or by automatically detecting a document size, and outputs a corresponding signal to the control unit 100. The roller group drive unit 103 corresponds to the first and second drive motors 32 and 35 for rotating the rollers 33, 34, and 37. The driver 104 connects to the third and fourth drive motors 42 and 46 for moving the paper takeout mechanism 30 comprising the support frame 40, the guide plates 31*a* and 31*b*, and the like in the directions x and y. The memory 102 stores, in units of the respective stacking plates 51*a*, 53, and 54, the shift amounts of the support frame 40 and the like, i.e., shift amounts x and y for which the support frame 40 and the like must be moved in order to take out the paper stored on the respective stacking plates 51*a*, 53, and 54.

The paper feed cassette 50 is mounted on the main body 1 and the respective paper $P_1$, $P_2$, and $P_3$ stored in the paper feed cassette 50 are selectively taken out. An operation for this will be described with reference to FIGS. 9 to 11 and 14.

Figure 9:
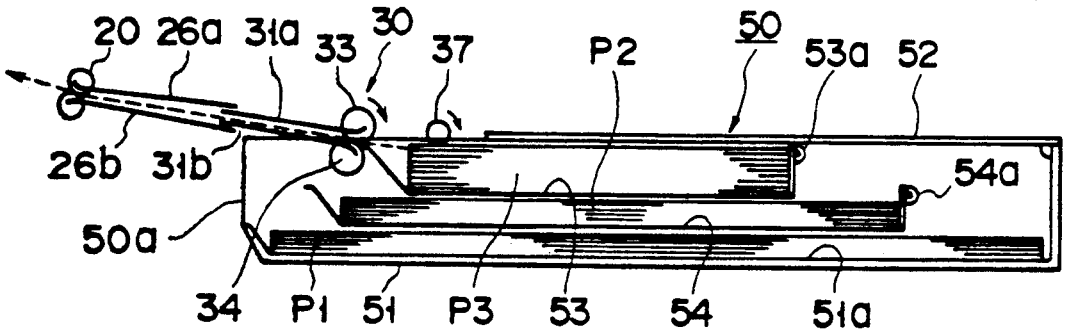
FIGS. 9 to 11 are illustrations showing paper feed states.

When a paper size to be used is set by the paper size setting means 101, a corresponding signal is output to the main control unit 100. The main control unit 100 receives signals associated with the predetermined shift amounts x and y corresponding to the determined paper size from the memory 102, and outputs this signal to the driver 104 to move the paper takeout mechanism 30 to a predetermined position. For example, when the paper $P_3$ stored in the uppermost first stacking plate 53 of the paper feed cassette 50 is set, the support frame 40 of the paper takeout mechanism 30 is moved upward by driving of the fourth drive motor 46, as shown in FIG. 9.

Subsequently, the support frame 40 is moved backward by driving of the third drive motor 42, so that the pickup roller 37 is located on the uppermost sheet of the paper $P_3$.

Figure 10:
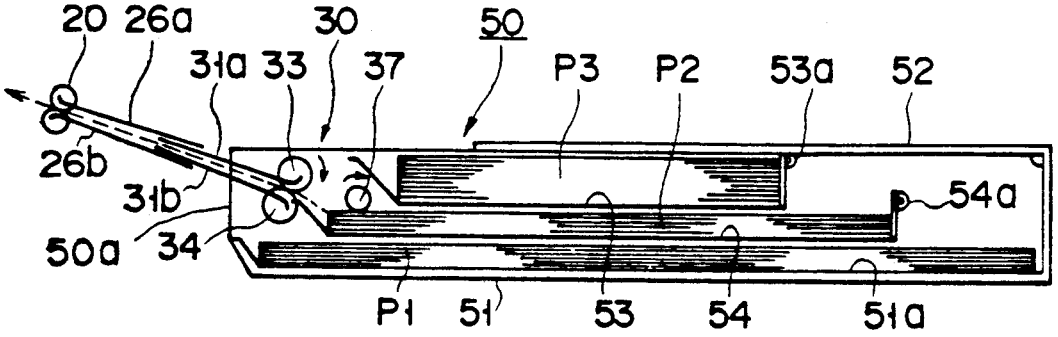

When the paper $P_2$ stored on the second stacking plate 54 is to be taken out, a similar operation is performed. That is, as shown in FIG. 10, the support frame 40 of the paper takeout mechanism 30 is moved forward by driving of the third drive motor 42, and then moved downward by driving of the fourth drive motor 46, so that the pickup roller 37 is located on the uppermost sheet of the paper $P_2$.

Figure 11:
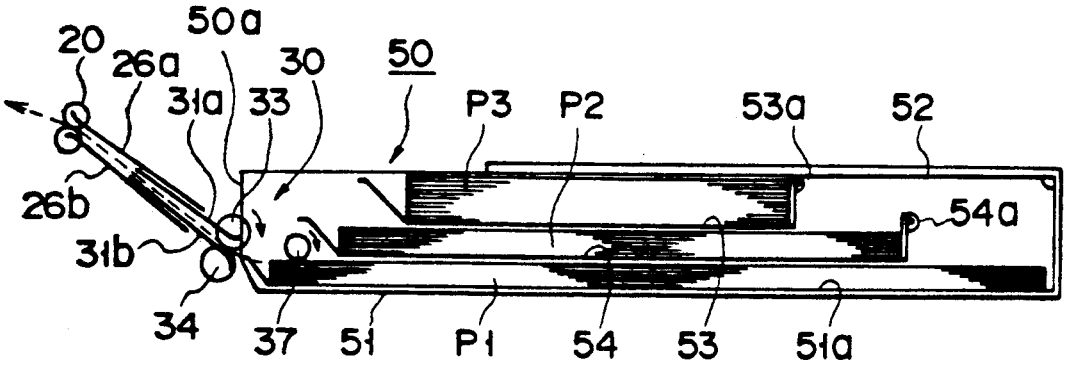

The major size paper $P_1$ stored in the lowermost inner bottom surface 51*a* of the cassette case 51 is taken out in the following manner. That is, as shown in FIG. 11, the support frame 40 of the paper takeout mechanism 30 is moved forward further by driving of the third drive motor 42, and then moved downward by driving of the fourth drive motor 46, so that the pickup roller 37 is located on the uppermost sheet of the paper $P_1$. In this manner, the paper takeout mechanism 30 according to the present invention can move the paper feed roller 33, the separation roller 34, and the pickup roller 37 toward the paper $P_1$, $P_2$, or $P_3$ stored in each stage of the paper feed cassette 50.

Figure 12:
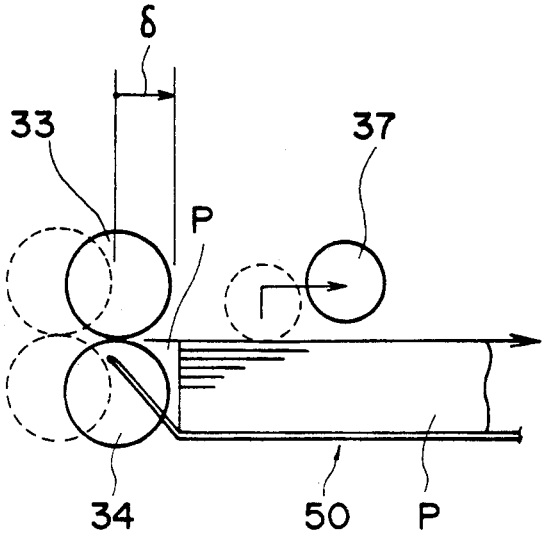
FIGS. 12 and 13 are illustrations showing a paper feeding means in a moving state.
Figure 13:
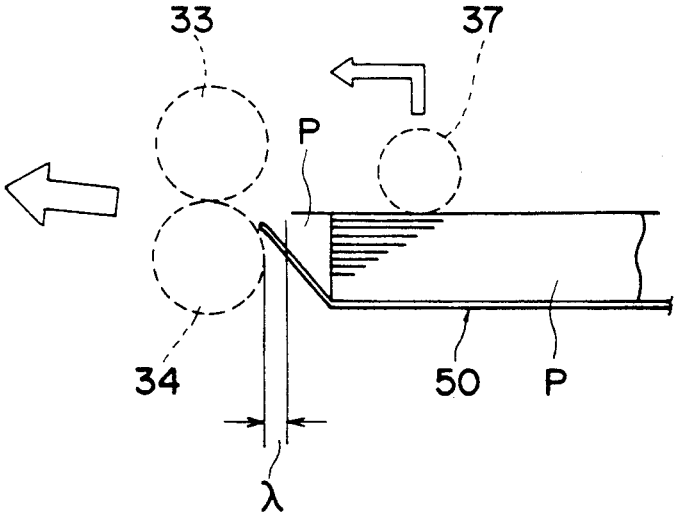

When copying to a predetermined count of paper by the image formation means 2 is completed, the main control unit 100 outputs a corresponding signal to the driver 104 to move the support frame 40 of the paper takeout mechanism 30 so that the paper feed roller 33 and the separation roller 34 are moved backward by a small amount $\delta$ while the pickup roller 37 is held lifted, as shown in FIG. 12. By this returning by the small amount $\delta$, the leading end of the paper P is stopped at a position $\lambda$ so as not to be interfered by the paper feed roller 33 and the separation roller 34, as shown in FIG. 13. When paper of a different size is set, the paper takeout mechanism 30 is moved to the position of another stacking plate. The mechanism of this operation is the same as that described above.

As is apparent from the above description, according to the present invention, paper of different sizes can be stored on a single support means. Therefore, unlike in a conventional case, since paper feed cassettes corresponding to different-sized paper need not be prepared, the cost can be decreased, and no extra space is needed to store paper feed cassettes which are not currently used.

Since the paper takeout means can move toward paper arranged on the respective stacking means, only a single pair of a paper feed means and a paper takeout means are required, a large cost reduction is achieved, and the apparatus size can be decreased.

Since the paper takeout means is guided to extend or to retract, the paper can be guided smoothly. Furthermore, since the paper takeout means can be moved to the paper side before moving to a next stacking means, unnecessary paper is returned by the paper takeout means and does not interfere with next paper to be used.

Since the maximum-sized paper is stored on the lowermost stacking means, the size of the support means is substantially the same as a conventional support means, and the setting states of the paper of the respective sizes can be easily confirmed from the above, thus simplifying setting.

In addition, since the storing height of the paper on the uppermost stacking means is larger than that of other stages, paper of a frequently used size can be set in the uppermost stacking means, and this setting can be easily performed.

Additional advantages and modifications will readily occur to those skilled in the art. Therefore, the invention in its broader aspects is not limited to the specific details, and representative devices, shown and described herein. Accordingly, various modifications may be without departing from the spirit or scope of the general inventive concept as defined by the appended claims and their equivalents.

What is claimed is:

1. A feeding apparatus for feeding image bearing members comprising:

a plurality of container means for storing image bearing members respectively, said container means being stacked on one another;

means for holding all of said container means so as to allow access to the image bearing members contained in each container means, said holding means being detachably mounted in the feeding apparatus and all of said container means being integrally detachable from the apparatus as a single unit when said holding means is detached from the apparatus; and means for individually taking out image bearing members contained in each container means when said holding means is mounted in the feeding apparatus.

2. The feeding apparatus according to claim 1, wherein said apparatus further comprises means for moving said taking out means to a position of taking out image bearing members stored in each container means.

3. The feeding apparatus according to claim 2, wherein said holding means includes means for vertically supporting said plurality of container means such that the surface of each container means, from which the image bearing members are taken out, is exposed.

4. The feeding apparatus according to claim 3, wherein said holding means includes means for supporting said plurality of container means such that at least part of the stacked image bearing members in each container is exposed.

5. The feeding apparatus according to claim 4, wherein said holding means includes means for pivotally supporting one side portion of each of said container means to allow the other side portion of said container means to be lifted.

6. An image forming apparatus comprising:

a plurality of stacking plates capable of stacking image bearing member of different sizes, said stacking plates being stacked on one another with predetermined gaps therebetween and displaced from one another so as to expose a part of the surface of image bearing members;

a box for storing said plurality of stacking plates, having an opening in a side surface thereof, and for pivotally supporting one side portion of each of said stacking plates so that said stacking plates can be lifted, said box being detachable;

a takeout roller for taking out image bearing members stacked on said stacking plates through the opening;

a roller support for supporting the takeout roller, said takeout roller support being capable of moving the takeout roller to a position for taking out image bearing members stacked on the stacking plates;

designating means for designating one of said container means to be taken out by the takeout means;

a first pulse motor for driving the support substantially vertically in response to the designating means, so that the takeout roller may be moved substantially vertically;

a second pulse motor for driving the support substantially horizontally in response to the designating means, so that the takeout roller may be moved substantially horizontally; and a transfer device for transferring the image formed on the photosensitive drum onto a paper sheet taken out by said paper takeout means.

7. The image forming apparatus according to claim 6, wherein said box includes means for vertically supporting said plurality of said stacking plates such that the surface of each stacking plate, from which the image bearing members are take out, is exposed.

8. The feeding apparatus according to claim 7, wherein said box includes means for supporting said plurality of stacking plates such that at least part of stacked image bearing members in each stacking plate is exposed.

9. The image forming apparatus according to claim 6, wherein said apparatus comprises a guide provided between said photosensitive drum and said roller support, said guide including:

a first guide plate provided to the photosensitive drum side; and a second guide plate, provided to the roller support, partially overlapping with said first guide plate, and movable toward the opening of said support; and said first and second pulse motors driving said second guide member to a position for taking out image bearing member stacked on said stacking plates.

10. The image forming apparatus according to claim 9, wherein said first and second pulse motors move said paper takeout roller so as to return a leading end of uppermost paper of the paper stacked on one stacking plate by a predetermined amount before said paper takeout roller is moved from a position for taking out paper stacked on said one stacking plate to a position for taking out paper stacked on another stacking plate.

11. A unit for feeding image bearing members comprising:

a plurality of container means for storing image bearing members respectively, said container means being stacked on one another; and means for vertically holding all of said plurality of container means such that the surface of each container means, from which the image bearing members are taken out, is exposed, all of said container means being integrally detachable from the feeding unit as a single unit when said holding means is detached from the apparatus;

whereby allowing access to the image bearing members contained in each container means.

12. An image forming apparatus comprising:

a plurality of container means, detachably mounted in the image forming apparatus for storing image bearing members respectively;

means for taking out image bearing members stacked in each container means when said container means is mounted in said image forming apparatus, said taking out means being movable from one of said container means to one of other container means;

means for designating one of said container means from which the image bearing members are to be taken out by said taking out means;

means for moving said taking out means to said container means designated by said designated means, said moving means including means for horizontally driving said taking out means and means for vertically driving said taking out means;

means for forming an image on the image bearing member taken out by said taking out means; and means for vertically supporting said plurality of container means such that the surface of each container means, from which the image bearing members are taken out, is exposed and wherein said holding means includes means for supporting said plurality of container means such that at least part of the stacked image bearing members in each container means is exposed and includes means for pivotally supporting one said portion of each of said container means to allow the other side portion of said container means to be lifted.

13. An image forming apparatus comprising:

a plurality of container means, detachably mounted in the image forming apparatus for storing image bearing members respectively;

means for taking out image bearing members stacked in each container means when said container means is mounted in said image forming apparatus, said taking out means being movable from one of said container means t one of other container means;

means for designating one f said container means form which the image bearing members are to be taken out by said taking out means;

means for moving said taking out means to said container means designated by said designated means, said moving means including means for horizontally driving said taking out means and means for vertically driving said taking out means;

means for forming an image on the image bearing member taken out by said taking out means;

guide means provided between said image forming means and said supporting means, said guide means including:

a first guide member provided on the image formation means side;

a second guide member, provided on the support means side, partially overlapping said first guide member, and being movable toward said container means;

said moving means including means for driving said second guide member to a position for taking out image bearing members stored in said container means; and wherein said moving means includes means for moving said taking out means so as to return a leading end of the uppermost image bearing member of the image bearing member stacked in one container means by a predetermined amount before said paper taking out means is moved from a position for taking out image bearing member stacked in said one container means to a position for taking out image bearing members stacked in another container means.

14. An image forming apparatus comprising:

a plurality of container means, detachably mounted in the image forming apparatus, for storing image bearing members respectively;

means for holding said plurality of container means for holding said plurality of container means vertically such that at least a part of the image bearing members stacked in each container means, from which image bearing members are taken out, is exposed;

means for pivotally supporting one side portion of each of said container means to allow another side portion of said container means to be lifted;

means for taking out image bearing members stacked in each container means when said container means is mounted in said image forming apparatus, said taking out means being movable from one of said container means to another of said container means;

means for designating one of said container means from which image bearing members are to be taken out by said taking out means;

means for moving said taking out means to the one of said container means designated by said designated means, said moving means including means for driving said taking out means horizontally and means for driving said taking out means vertically; and means for forming an image on image bearing members taken out by said taking out means.

15. An image forming apparatus comprising:

a plurality of container means, detachably mounted in the image forming apparatus, for storing image bearing members;

means for taking out image bearing members stacked in each container means when said container means is mounted in said image forming apparatus, said taking out means being movable from one of said container means to another of said container means;

means for designating one of said container means from which image bearing members are to be taken out by said taking out means;

means for moving said taking out means to the one of said container means designated by said designated means, said moving means including means for driving said taking out means horizontally and means for driving said taking out means vertically;

means for forming an image on the image bearing members taken out by said taking out means;

guide means for guiding image bearing members stored in said container means to said image forming means, said guide means including:

a first guide member for guiding image bearing members taken out from said container means;

a second guide member for guiding image bearing members from said first guide member to said image forming means, said second guide member partially overlapping said first guide member and being movable toward said container means;

means for driving said second guide member to a position of taking out image bearing members stored in said container means; and means for moving said taking out means so as to return a leading end of the uppermost stacked in one container means by a predetermined amount before said taking out means is moved from a position for taking out image bearing members stacked in said one container means to a position for taking out image bearing members stacked in said one container means to a position for taking out image bearing members stacked in another container means.

* * * * *